United States Patent [19]

Wagner

[11] Patent Number: 4,872,225

[45] Date of Patent: Oct. 10, 1989

[54] CLEANING APPARATUS AND METHOD FOR BATH ENCLOSURES

[76] Inventor: John C. Wagner, 4505 S. Yosemite, #379, Denver, Colo. 80237

[21] Appl. No.: 240,209

[22] Filed: Sep. 6, 1988

[51] Int. Cl.[4] ..... A47K 4/00

[52] U.S. Cl. ..... 4/662; 4/601; 134/168 R

[58] Field of Search ..... 4/596, 597, 600, 601, 4/605, 612, 615, 616, 617, 618, 662; 239/559, 567, 209; 128/366; 134/167 R, 168 R, 169 R, 22.18

[56] References Cited

U.S. PATENT DOCUMENTS

| | | | |
|---|---|---|---|
| 1,343,892 | 6/1920 | Bagnulo | 4/601 X |
| 1,406,070 | 2/1922 | Patton | 239/567 X |
| 1,448,975 | 6/1922 | Nenonen | 128/66 X |
| 2,605,478 | 8/1952 | Lassiter | 134/168 R |
| 3,010,115 | 11/1961 | Wiggs | 4/300 |
| 3,192,950 | 7/1965 | Weese et al. | 4/605 X |
| 3,230,550 | 1/1966 | Carlson | 4/597 |
| 3,322,347 | 5/1967 | Pierce | 239/559 X |
| 3,342,419 | 9/1967 | Weese | 239/567 X |
| 3,381,312 | 5/1968 | Whitla | 4/662 |
| 3,603,510 | 9/1971 | Wagner | 239/567 X |
| 3,630,777 | 12/1971 | Ishizawa | 134/169 R X |
| 3,713,176 | 1/1973 | Stock | 4/662 |
| 3,742,520 | 7/1973 | Bernardi | 4/662 |
| 3,755,826 | 9/1973 | Roberts | 4/662 |
| 3,837,011 | 9/1974 | McTighe et al. | 4/662 |
| 4,068,326 | 1/1978 | Deechler | 4/534 |
| 4,142,257 | 3/1979 | Mace | 4/615 |
| 4,183,105 | 1/1980 | Womack | 134/167 R |
| 4,233,692 | 11/1980 | Sinsley | 4/662 |
| 4,241,744 | 12/1980 | Jordan, Sr. | 134/168 R |
| 4,383,341 | 5/1983 | Altman | 134/168 R X |
| 4,496,519 | 1/1985 | McGuire | 134/168 R X |
| 4,554,690 | 11/1985 | Knapp et al. | 4/601 |

FOREIGN PATENT DOCUMENTS

| | | | |
|---|---|---|---|
| 182656 | 8/1966 | U.S.S.R. | 239/567 |
| 483160 | 12/1975 | U.S.S.R. | 134/167 R |
| 2200382 | 8/1988 | United Kingdom | 4/662 |

*Primary Examiner*—Henry K. Artis

*Attorney, Agent, or Firm*—Fields, Lewis, Pittenger & Rost

[57] ABSTRACT

A cleaning device in a bath enclosure connected to a water supply pipe and to a shower head and operable to direct water flow through either the shower head or a spray head disposed in an upper portion of the bath enclosure. The spray head has a plurality of discharge openings arranged to direct streams of fluid in a spread pattern so as to wash down substantially the entire inside surface of the bath enclosure. An injector assembly permits a container to introduce a cleaning fluid into the water to be sprayed through the spray head. One form disclosed has a diverter valve between the shower head and water supply pipe and the other form has a diverter valve at the hot and cold water control valves.

20 Claims, 3 Drawing Sheets

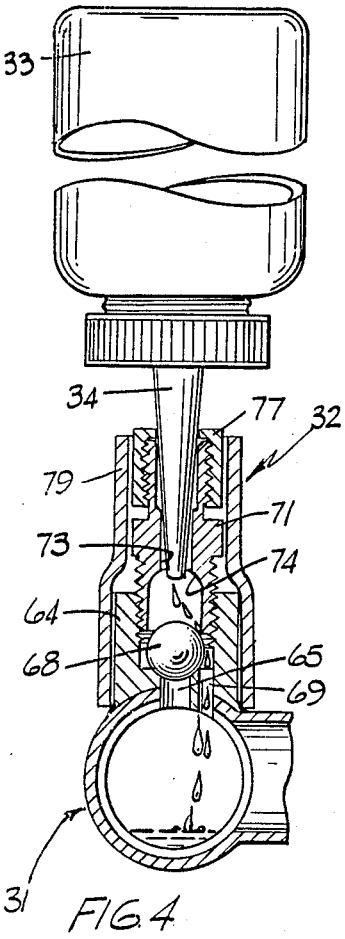
FIG. 4
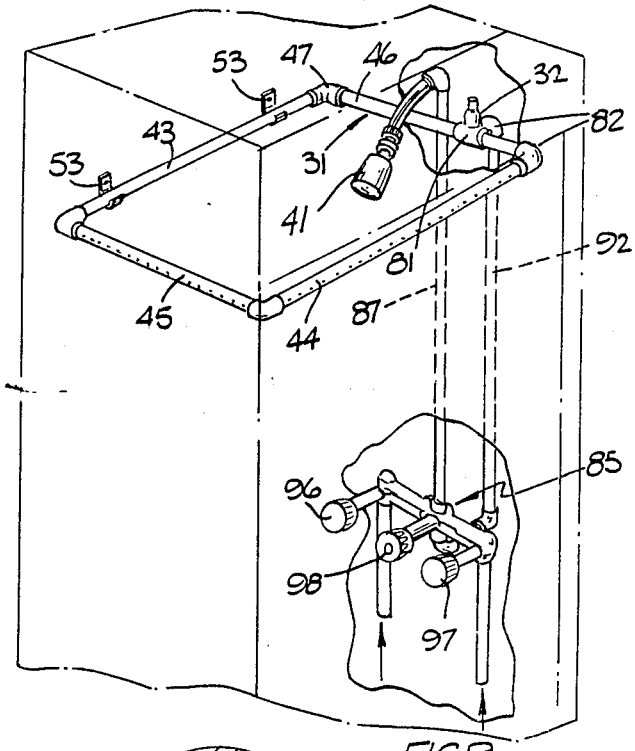
FIG. 9
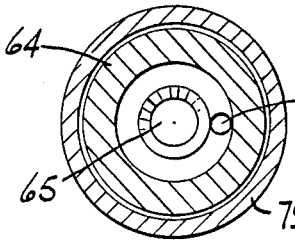
FIG. 6
FIG. 5
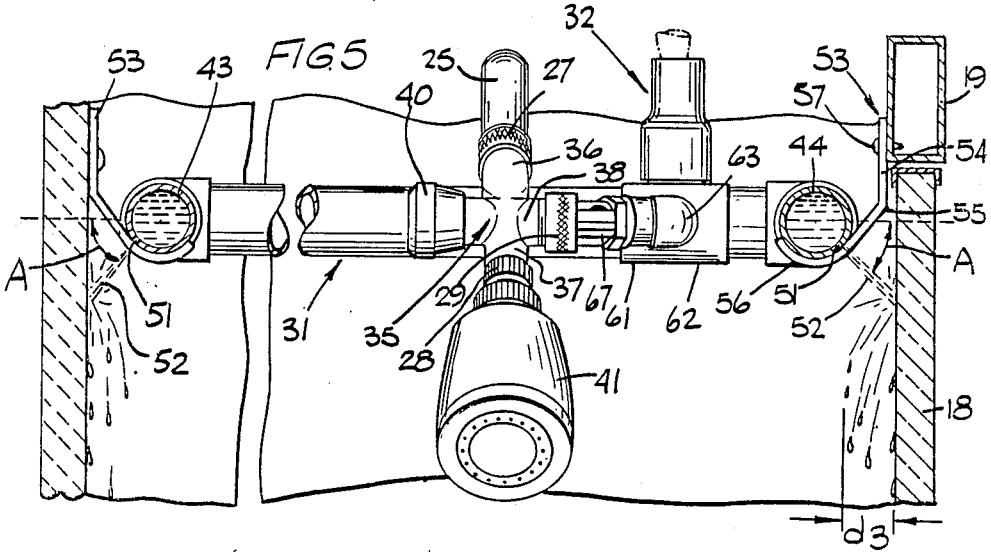

CLEANING APPARATUS AND METHOD FOR BATH ENCLOSURES

TECHNICAL FIELD

This invention relates to a novel and improved apparatus and method for cleaning bath enclosures.

BACKGROUND ART

The inner surfaces of bath enclosure walls and the glass doors collect scum and dirt and become spotted after extended periods of use. The prior practice for cleaning such bath enclosures has usually been the application of a cleaner and scrubbing by hand. A number of stationary or in situ spray devices have been devised for spray-cleaning the inside wall surfaces of rest rooms. Representative U.S. patents showing spray-cleaning apparatus in rest rooms are: U.S. Pat. Nos. 3,381,312, 3,713,716, 3,742,520 and 3,837,011. A water distribution system for showers is disclosed in U.S. Pat. No. 4,554,690.

DISCLOSURE OF INVENTION

A cleaning device and method for a bath enclosure, particularly shower stalls of a variety of sizes and configurations, includes a spray head in the form of a pipe arranged in an endless or closed loop configuration that generally corresponds with the shape of the bath enclosure and is mounted in an upper portion of the bath enclosure in spaced relation thereto to spray against an adjacent inside surface thereof. The spray head has a series of spaced discharge openings arranged to spray streams of a cleaning liquid at a selected downward angle and rinse substantially the entire inner surface area of the bath enclosure below where the streams strike the inside surface. An injector assembly enables a spray cleaning fluid in a container to be selectively introduced into and mixed with the water to provide a cleaning fluid that is then sprayed by the spray head. One form of the invention utilizes a diverter valve between the water supply pipe and the shower head and another form utilizes the diverter valve associated with the hot and cold water valves which control the water flow to the water supply pipe.

BRIEF DESCRIPTION OF DRAWINGS

FIG. 4 is a sectional view taken along the same line as FIG. 3 with the cleaning fluid container spout inserted to inject cleaning fluid and the ball of the check valve shown in a lower position enabling the cleaning fluid to pass into the water stream and through the spray head;

FIG. 5 is a sectional view taken along line 5—5 of FIG. 1;

FIG. 6 is a sectional view taken along line 6—6 of FIG. 3;

FIG. 9 is a perspective view of another embodiment of the cleaning device embodying features of the present invention;

DETAILED DESCRIPTION

Figure 1:
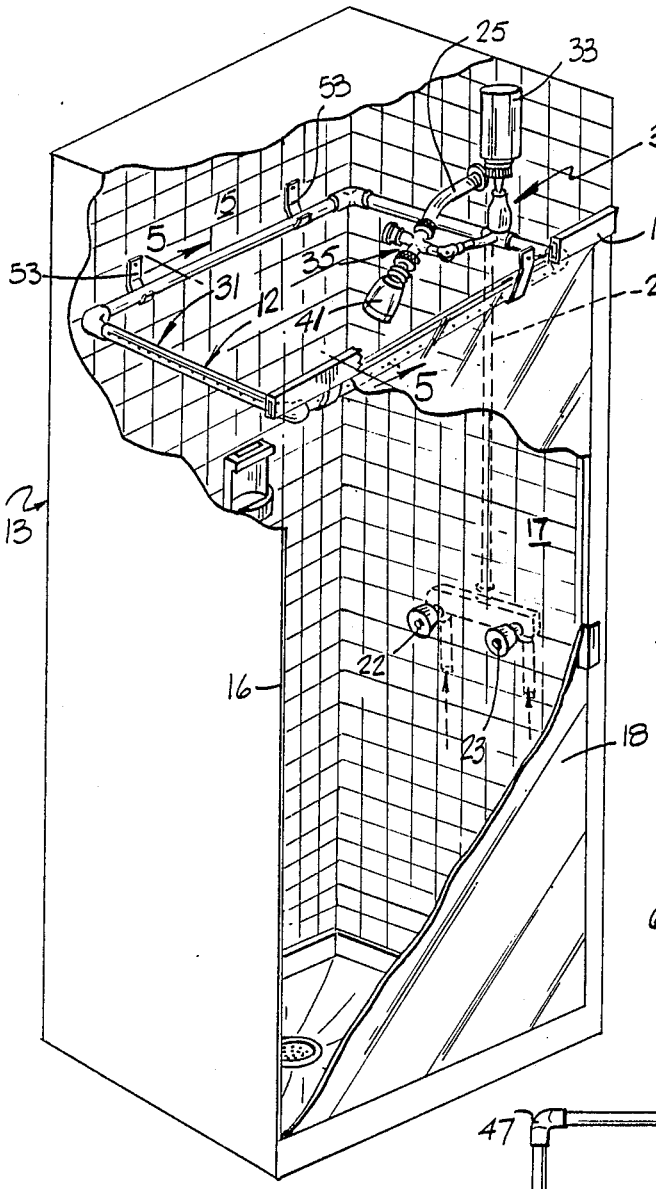
FIG. 1 is a perspective view of a cleaning device embodying features of the present invention in a shower stall with walls forming a bath enclosure and a portion of the door broken away to show interior parts.

Referring now to FIGS. 1–8 there is shown a cleaning device 12 according to the present invention installed in a bath enclosure 13. The bath enclosure 13 shown is a conventional shower stall in a generally rectangular configuration having a rear wall 15, opposed spaced side wall 16 and 17 and a movable front door 18. The door 18 is pivoted to side wall 16 at a hinge 20 (FIG. 7) to move between open and closed positions to enable the user to pass through the door opening to gain access into the shower stall. The shower stall shown has a stationary frame including a tubing section 19 above the door. The door 18 also may be of the sliding type provided in two sections that slide in suitable channels to facilitate opening and closing thereof as is conventional practice in the shower stall art.

A hot and cold water supply pipe 21, which is part of the internal plumbing, extends behind side wall 17 and through an upper portion of the side wall 17 into the shower stall. A hot water control valve 22 and a cold water control valve 23 inside the stall are used to control the flow of hot and/or cold water delivered through pipe 21 in a conventional manner. A supply pipe extension 25 having external threads at both ends threads into internal threads in the outlet end of the water supply pipe 21 and a spray shower head usually has a female coupling with internal threads that threads onto the threads on the outer free end of extension 25.

The cleaning device 12 of the present invention, in general, includes a spray manifold or spray head 31 of a closed or endless configuration and generally conforming to the contour or shape of the inside of the bath enclosure 13, and injector assembly 32 which receives a container 33 having a tapered spout 34 and containing a cleansing fluid and a diverter valve assembly 35 having an inlet branch 36 and two outlet branches 37 and 38. The inlet branch 36 removably couples to the supply pipe extension 25 by means of collar 27 that rotates on the end of branch 36 and has internal threads that thread on the free end of extension 25. The assembly 35 directs the flow of water from inlet branch 36 to either a shower head 41 removably coupled to outlet branch 37 or the spray head 12 removably coupled to outlet branch 38 according to the setting of a push-pull knob 40. The removable coupling for the shower head is external threads on the end of branch 37 and a collar 28 with internal threads rotatably mounted on the end of the shower head. The removable coupling for the spray head to the diverter assembly is external threads on outlet branch 38 with a collar 29 with internal threads threaded on branch 38.

Figure 8:
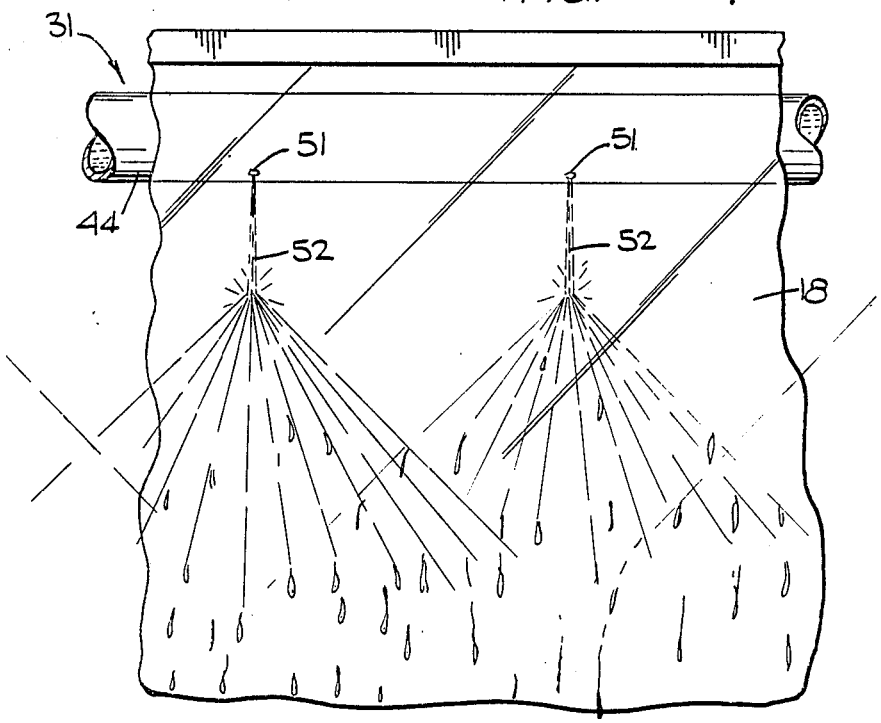
FIG. 8 is a sectional view taken along line 8—8 of FIG. 7 showing the spreading pattern for the discharge cleaning fluid.

The spray head 31 shown is generally rectangular having a straight rear pipe 43, straight front pipe 44 arranged parallel to the spaced apart from one another and two parallel spaced straight side pipes 45 and 46 connected at the four corners by ell pipe fittings 47. The pipes and the corner fittings are rigid and they are rigidly connected so the spray head 31 is a rigid unit. The pipe or tubing is preferably copper or brass plated with chrome bright brass gold or may be made from plastic or PVC. The spray head 31 shown is made of ¾ inch tubing with ¾ inch fittings. Each pipe has a series or plurality of discharge openings 51 formed therein arranged to direct a stream of water 52 down at a selected downward angle to the horizontal designated A. An angle of 40 degrees has provided good results in that the fluid will not splash up and will spread out satisfactorily. A range of angles between 20° and 50° from the horizontal would also provide a suitable spread pattern. The space between the discharge openings 51 along the sidewalls is a selected distance designated d1 and this distance along with angle A is selected so that the water and cleaning fluid mixture spreads or fans out and overlaps with the next adjacent discharge opening as shown in FIG. 8 to wash down and clean substantially the entire inner surface area below the discharge openings. The space between the end discharge opening and the adjacent wall is a selected distance designated d2 at each corner. In practice, having the discharge opening 51 formed by a #52 drill and d1 is 3 inches and d2 is 2 inches has provided satisfactory results. The cleaning liquid in container 33 is a detergent liquid cleaner to minimize dirt and scum build-up or a water spot remover to minimize water spots particularly on glass doors.

The spray head 31 is shown mounted to the walls and above the door by a plurality of spaced apart support bracket 53. The number of brackets 53 will depend on the length of the pipe being supported. As best seen in FIG. 5, each bracket has a flat section 54, and inclined section 55 and a curved bottom support section 56. The flat section 54 buts against the supporting surface and is secured thereto as by a screw fastener 57. The inclined section spaces the curved support section 56 a selected distance designated d3 from the surface being sprayed. The distance d3 preferably is about ⅜ to ½ inch. The support section 56 provides a cradle-like support on which the spray head rests.

The injector assembly 32 includes a T-fitting with a central body 60 having two aligned branches 61 and 62 coupled in and forming a part of pipe 46 and a third branch 63 having a intermediate pipe section 67 that in turn has a fitting removably coupled to outlet branch 38 of the diverter valve assembly 35 by collar 29. The T-fitting 60 has a top branch 64 extending up from body 60 with a central flow passage 65 in which there is provided a check valve. Top branch 64 shown has the external shape of a six-sided nut and has internal threads 66. Another smaller passage 69 is formed in body 60 along and space from passage 65 so that when the ball 68 of the check valve is in a down position a fluid introduced into the top will flow through the valve passage 69 and into the spray head 31. Other arrangements to let the fluid flow into the water stream when the ball of the check valve is down would include making the passage generally elliptical and larger than the ball valve.

Figure 3:
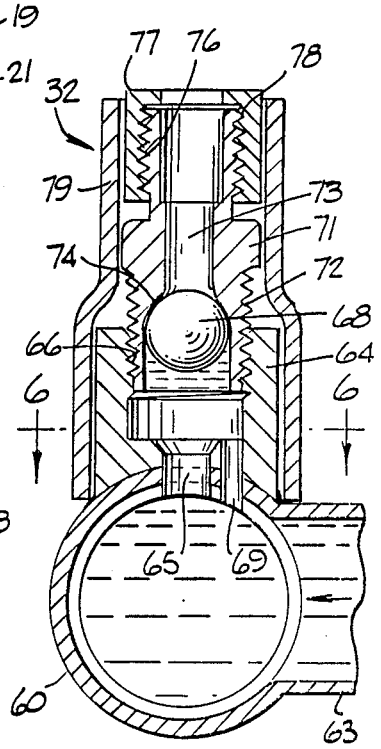
FIG. 3 is a sectional view taken along line 3—3 of FIG. 2 through the injector assembly showing the ball of the check valve in an up position to prevent back flow.
Figure 2:
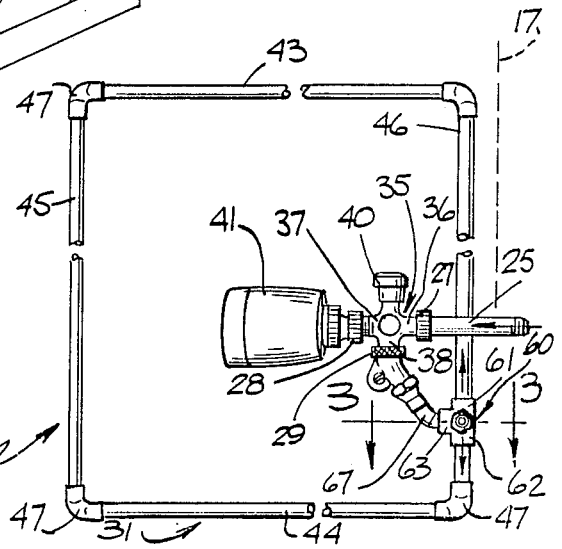
FIG. 2 is a top plan view of the cleaning device shown in FIG. 1 with only the adjacent sidewall through which water is supplied shown in dashed lines.
Figure 7:
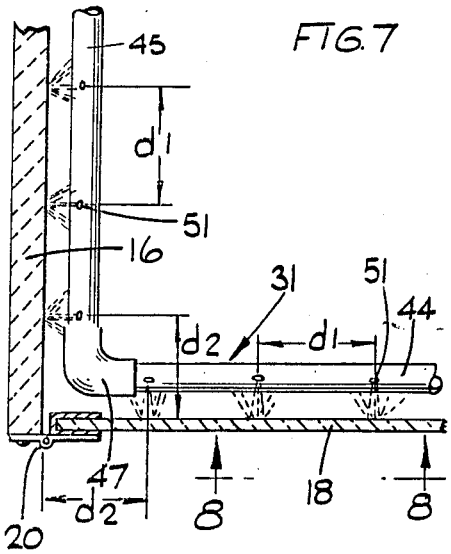
FIG. 7 is a top plan view of a corner of the cleaning device shown in FIG. 1 spraying against the inside wall surface.

A male fitting 71 has external threads 72 at one end that thread into the internal threads 66 in the top branch 64 so as to contain the ball of the check valve for up and down movement therein. Fitting 71 has an internal passage 73 and the upper end forms an internal seat surface 74 for the ball 68 so that when the ball is pushed up by water pressure the fluid is blocked from flowing out the top branch as is seen in FIG. 3.

The fitting 71 further has external threads 76 at the top end. An end nut 77 with internal threads 78 threads on the external threads 76 of fitting 71. A removable sleeve 79 slides over the fittings and branch for esthetic purposes. The injector assembly 32 shown is made from a 5/16 inch compression fitting of brass and is reworked to utilize a relatively light, 8 mm plastic ball 68.

The cleaning fluid container 33 has a tapered pour spout 34 that inserts into the passage 73 in fitting 71 as seen in FIG. 4 so that the spout will push the ball valve 68 down and the cleaning fluid will pass through branch 64 via passage 69 into the water in the spray head to bath enclosure mixed therewith. A seal is formed between the internal passages of nuts 77 and fitting 71 to prevent the backflow of fluid through the injector assembly as seen if FIG. 4. The container 33 is made of plastic and is compressible so that a squeeze thereof injects the cleaning fluid into the injector assembly.

In a full sequence of operation, after a user has taken a shower, valve 40 is moved to direct water flow from pipe 21 into the spray head 31. The spout 34 is inserted into the injector assembly as shown in FIG. 4. The container 33 is squeezed to introduce the cleaning liquid into the water and mix therewith to be sprayed against the wall surfaces as seen in FIGS. 5 and 8. After a suitable spray down the water control valves 22 and 23 are turned off and valve 40 is returned to the other position to enable use of the shower head 41 for the next shower.

Figure 10:
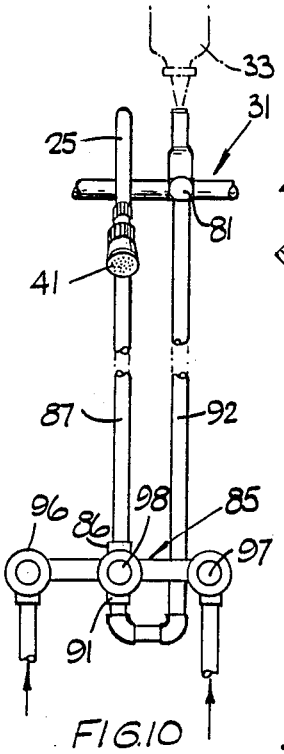
FIG. 10 is a front elevational view of the device shown in FIG. 9.
Figure 11:
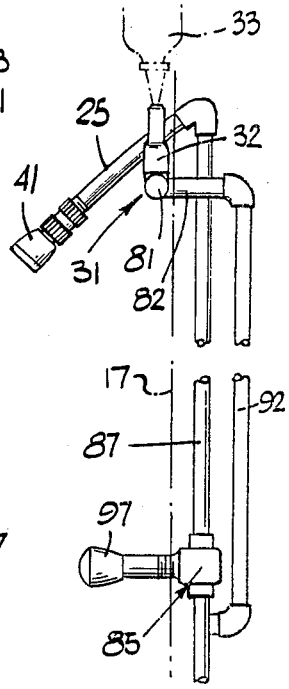
FIG. 11 is a side elevational view of the device shown in FIG. 9 with the sidewall shown in dashed lines.

Another form of cleaning device according to the present invention shown in FIGS. 9–11 has the same spray head 31 made up of four straight rigid pipe sections 43, 44, 45 and 46 arranged in a four-sided rectangular configuration but with a modified T-fitting with a central body 81 connected in pipe 46. The injector assembly 32 of this form is a part of the top branch of the T-fitting body as above describe. Water from a supply pipe is brought into the back of the T-fitting body 81 by a back branch 82 that passes through the sidewall 17 of the shower stall.

A diverter valve 85 of this form is a conventional diverter valve presently used in shower installations and made as a permanent part of the installation during new construction. Valve 85 is mounted behind the shower side wall 17 with the control knobs 96, 97 and 98 described hereinafter being inside the shower stall. The diverter valve 85 has an upper outlet branch 86 coupled to a vertical shower pipe 87 behind wall 17 with pipe 87 having its upper end coupled to extension 25 which in turn is coupled to the shower head 41. Diverter valve 85 has a lower outlet branch 91 to which there is coupled a pipe 92 extending up behind wall 17 and coupled to branch 82 which in turn connects to spray head 31. There is a control knob 96 for hot water, a control knob 97 for cold water and a diverter control knob 98 to divert the water flow to either the shower head 88 or to the spray head 31 for the operation in the same manner as the form shown in FIGS. 1–8 above described.

Form the foregoing it is apparent that the cleaning device and method of the present invention can being installed after the home or apartment shower stalls are already in use or in the alternative it can also be installed in new construction using a conventional 3-way diverter valve that is associated with the hot and cold water valves.

Although the present invention has been described with a certain degree of paraticularity, it is understood that the present disclosure has been made by way of example and that changes in details of structure may be made without departing from the spirit thereof.

What is claimed is:

1. A cleaning device for a bath enclosure that is usable in combination with a shower head and a water supply pipe comprising:

spray means for mounting in an upper portion of a bath enclosure, said spray means including a spray pipe shaped to extend along the inside surface of a bath enclosure, said spray pipe having a plurality of discharge opening selectively located at spaced intervals along an outer side of the pipe, each said discharge opening being substantially the same distance from the inside surface of the bath enclosure and arranged for directing and spraying a liquid stream at a downward angle in an overlapping pattern against substantially the entire inside surface of at least one wall of said bath enclosure, water flow control and support means arranged for supporting and supplying water to a shower head to spray inside the bath enclosure and supporting and in the alternative supplying water to said spray means, and fluid injection means for introducing a cleaning fluid into the water flowing from a water supply pipe to said spray means to provide a cleaning liquid that is sprayed by said spray means against said inside surface and flows down along an inside surface area of said wall to clean substantially all of said inside surface area.

2. A cleaning device as set forth in claim 1 including connection means to removably couple said spray means to a water supply pipe that supplies said spray means with water.

3. A cleaning device as set forth in claim 1, said water and control support means including diverter means for diverting water from said water supply pipe to either said spray means or to a shower head.

4. A cleaning device as set forth in claim 3 wherein said diverter means is coupled between an outlet of a water supply pipe and a shower head.

5. A cleaning device as set or forth in claim 3 wherein said diverter means is coupled to the control valves for regulating the flow control to the water supply pipe.

6. A cleaning device as set forth in claim 3 wherein said diverter means includes a control member to set the fluid flow therethrough to either said spray head or said shower head.

7. An apparatus as claimed in claim 6 wherein said discharge openings are directed at a downwardly directed angle between about 20° and 50° from the horizontal so as to prevent a splash and cause the liquid to spread across a wall surface being cleaned.

8. An apparatus as claimed in claim 6 wherein said discharge openings are directed downwardly towards said walls at a downwardly directed angle of about 40° from the horizontal so as to prevent a splash and cause the liquid to spread across a wall surface area being cleaned.

9. A cleaning device as set forth in claim 6 wherein said spray means includes a length of pipe arranged in a closed loop, four-sided configuration that substantially conforms to the configuration of the bath enclosure.

10. A cleaning device as set forth in claim 6 wherein said discharge openings are spaced a selected distance from the inside of said bath enclosure and are directed at said angle to form streams that spread in a pattern when the stream strikes said inner surface to form a plurality of spread patterns with the patterns of adjacent streams overlapping.

11. A cleaning device as set forth in claim 1 wherein said fluid injection means includes a body with a flow passage containing a check valve which permits the flow of said cleaning fluid into water flowing to said spray means but prevents a return flow of said cleaning fluid and water being supplied to said spray means from backflowing through said check valve.

12. A cleaning device as set forth in claim 1 wherein said fluid injection means includes a body with an inlet passage to receive a spout of container containing a cleaning fluid so that said cleaning fluid can be dispensed into water discharged to said spray means via said inlet port without leakage of said fluid between the interface of said spout and said inlet passage.

13. A cleaning device as set forth in claim 12 wherein said container is elastically compressible so that said cleaning fluid is dispensed therefrom by compressing said container.

14. A cleaning device as set forth in claim 1 wherein said cleaning fluid is a water spot remover.

15. A cleaning device as set forth in claim 1 wherein said cleaning fluid includes a detergent liquid cleaner.

16. A cleaning device for a bath enclosure that is usable in combination with a shower head and a water supply pipe comprising:

spray means arranged for spraying an upper portion of a plurality of walls defining a bath enclosure, said spray means shaped to extend around the contour of the inside of the bath enclosure and including a length of conduit provided with a plurality of selectively located discharge openings along an outer side of said conduit for directing and uniformly spraying a cleaning liquid in an overlapping spray pattern onto said upper portion so that said liquid rinses substantially all of the surface area of said side walls located below said upper portion for cleaning said walls;

water flow control and support means arranged for supporting and supplying water to a shower head to spray inside the bath enclosure and for supporting and in the alternative supplying water to said spray means, said water flow control and support means including diverter means for switching the direction of the flow of said water back and forth between a first position for directing said water to said spray means and a second position for directing said water to said shower head; and fluid injection means for introducing cleaning fluid into said spray means so that said cleaning fluid combines with water in said spraying means to provide said cleaning liquid.

17. A cleaning device as set forth in claim 16 wherein said source of pressurized water includes a water supply pipe extending through a wall of a four-sided bath enclosure and wherein said connect means is connected to said water supply pipe and wherein said length of conduit is connected to said connect means and supported thereby, said length of conduit also being rectangularly shaped so that each side of the rectangularly shaped conduit sprays a separate side wall of the bath enclosure with said liquid.

18. In combination, a generally four-sided bathing enclosure having three walls and a movable door, a water supply including flow control valve means for supplying hot and cold water to said enclosure, and shower head means for spraying water into said enclosure, and a device for cleaning said enclosure, said device including:

water flow control and support means for supporting and supplying water to said shower head means and including diverter means connectable to said water supply means for switching the direction of the flow of water back and forth between a first position for discharge of said water to said shower head means and a second position for discharge of said water through a second outlet;

spray means supplied by said water flow control and support means arranged for spraying an upper portion of the side walls of the bathing enclosure, said spray means including a spray pipe shaped to extend around the inside of a bath enclosure having a plurality of discharge openings at spaced intervals along an outer side of said spray pipe for directing and spraying a liquid stream against an upper portion of said side walls, said spray pipe being removably connected to said second outlet for receiving water therefrom when the diverter means is in the second position; and fluid injection means for introducing a cleaning fluid into the water flow to said spray means so that said cleaning fluid combines with water supplied via said diverter means to provide a cleaning liquid containing said water and said cleaning fluid for spraying onto an upper portion of the inside surface area of said bath enclosure, said liquid running down said side walls after being sprayed onto said upper portion threeof so as to rinse said side walls with said cleaning liquid, said liquid thereby cleaning said inside surface area.

19. The combination, as set forth in claim 18 including bracket means mounted to the inside of said bath enclosure to support said spray means a selected distance from the inside of said bath enclosure.

20. The combination, as set forth in claim 19 wherein said bracket means includes a straight portion fastened to the bath enclosure, an inclined portion, and a lower curved portion on which the spray means seals.

* * * * *